US011027866B2

(12) United States Patent
Neumann et al.

(10) Patent No.: US 11,027,866 B2
(45) Date of Patent: Jun. 8, 2021

(54) STRAPPING APPARATUS

(71) Applicant: TITAN Umreifungstechnik GmbH & Co. KG, Schwelm (DE)

(72) Inventors: Frank Neumann, Velbert (DE); Bjoern Andreas, Iserlohn (DE)

(73) Assignee: TITAN UMREIFUNGSTECHNIK GMBH & CO. KG, Schwelm (DE)

( * ) Notice: Subject to any disclaimer, the term of this patent is extended or adjusted under 35 U.S.C. 154(b) by 180 days.

(21) Appl. No.: 16/387,616

(22) Filed: Apr. 18, 2019

(65) Prior Publication Data

US 2019/0322398 A1 Oct. 24, 2019

(30) Foreign Application Priority Data

Apr. 19, 2018 (EP) ..... 18168243

(51) Int. Cl.

| | |
|---|---|
| ***B65B 13/18*** | (2006.01) |
| ***B65B 13/02*** | (2006.01) |
| ***B65B 13/22*** | (2006.01) |
| *B65B 27/08* | (2006.01) |

(52) U.S. Cl.

CPC ..... *B65B 13/187* (2013.01); *B65B 13/027* (2013.01); *B65B 13/22* (2013.01); *B65B 27/08* (2013.01)

(58) Field of Classification Search

CPC ..... B65B 13/22; B65B 13/187; B65B 13/027; B65B 13/025; B65B 13/184; B65B 13/185; B65B 13/186; B65B 13/188; B65B 27/08

See application file for complete search history.

(56) References Cited

U.S. PATENT DOCUMENTS

| | | | | | |
|---|---|---|---|---|---|
| 3,232,217 | A | * | 2/1966 | Harmon | B65B 13/34 100/30 |
| 3,536,430 | A | * | 10/1970 | Yasumori | B65B 13/02 100/4 |
| 4,218,969 | A | * | 8/1980 | Kasuga | B65B 13/22 100/26 |
| 5,112,004 | A | * | 5/1992 | Tipton | B65B 13/184 226/118.4 |
| 5,155,982 | A | * | 10/1992 | Boek | B65B 13/22 100/29 |

(Continued)

FOREIGN PATENT DOCUMENTS

| | | | |
|---|---|---|---|
| DE | 102008004118 | A | 7/2009 |
| GB | 885371 | A | 12/1961 |
| GB | 2041869 | A | 9/1980 |

*Primary Examiner* — Thomas M Wittenschlaeger
(74) *Attorney, Agent, or Firm* — Andrew Wilford

(57) ABSTRACT

A strapping apparatus has a frame, a single drive motor carried on the frame and having an output shaft, a feed roller connected to the motor and rotatable on the frame, and a tightening roller connected to the motor and rotatable on the frame. A strap from a supply is spanned over and passes between the feed and tightening roller to the object. A lever is pivoted on the frame parallel to the feed and tightening axes for movement between two angularly offset end positions. A feed counter roller freely rotatable on the lever is engageable in one of the end positions with the feed roller to pinch and advance the strap toward the object, and a tightening counter roller rotatable on the lever is engageable in the other of the end positions with the tightening roller to pinch and pull the strap away from the object.

10 Claims, 2 Drawing Sheets

(56) References Cited

U.S. PATENT DOCUMENTS

| | | | | | |
|---|---|---|---|---|---|
| 5,377,477 | A * | 1/1995 | Haberstroh | B65B 13/22 53/399 |
| 5,459,977 | A * | 10/1995 | Haberstroh | B65B 13/22 53/399 |
| 6,155,032 | A * | 12/2000 | Lai | B65B 13/22 100/29 |
| 2017/0015450 | A1 * | 1/2017 | Huber | G06K 9/222 |

* cited by examiner

STRAPPING APPARATUS

FIELD OF THE INVENTION

The present invention relates to a strapping apparatus. More particularly this invention concerns such an apparatus driven by a motor.

BACKGROUND OF THE INVENTION

A known power strapping apparatus has with a drive motor, a feed roller for pulling a strap from a strap supply, at least one tightening roller for tightening the strap once it is wrapped around the object to be strapped, and a joining device for connecting the ends of the strap that is wrapped around the object.

An object such as a stack of newspapers, packages, etc., is generally consolidated with the aid of a strapping apparatus. To this end, the strap is first wrapped around the object to be strapped. This is done using the apparatus's feed roller. The strap is then tightened using the tightening roller. Once in this tightened state, a loop of the strap is separated from the strap of the supply. Then, the two ends of the loop of strap are pressed against one another and joined together in the joining device. If the strap is made of plastic, for example, the strap ends are joined by welding, for example by friction welding. Steel strap is crimped with a clip.

As a rule, the feed roller and the tightening roller are each equipped with a counter-roller, so that a pair of cooperating feed counter rollers as well as a pair of cooperating tightening counterrollers are present, and each pair can pinch the strap. The strap is thus fed out with the aid of the feed roller and its counter-roller. The tightening roller, in conjunction with the respective counter-roller, ensures that the strap is tightened after it has been wrapped around the object to be strapped. This is described in detail in the generic prior art according to DE 10 2008 004 118.

The known teaching according to DE 10 2008 004 118 uses only a single drive motor on whose motor shaft one of the feed rollers is arranged, that is, the feed roller itself or the counter-roller or the so-called feed counter-roller interacting with the feed roller. In addition, a transmission is provided that transmits the rotation of the motor shaft of the drive motor through a reduction gear. The reduction gear drives at least one of the tightening rollers, that is, the tightening roller or the associated counter-roller or tightening counter-roller. This has proven to be advantageous in principle, because only a single drive motor provides for the feeding and the tightening, whereas two drive motors are often used in practice in the prior art. However, the invention expressly does not exclude two drive motors in this context, for example. For instance, a drive motor for driving the tightening roller or the tightening rollers and an additional drive motor for driving the feed roller or the feed rollers can be provided.

In the prior art according to US 2017/0015450, a strapping apparatus is described that employs a single drive to drive a strip feeder, a strap retractor, and finally a tightener. The intention is to enable the strapping head of the strapping apparatus to have an especially compact design.

According to GB 2 041 869 describes a strapping apparatus in which the interaction of two feed rollers is described. One of the feed rollers can be moved back and forth using a lifting arrangement.

OBJECTS OF THE INVENTION

It is therefore an object of the present invention to provide an improved strapping apparatus.

Another object is the provision of such an improved strapping apparatus that overcomes the above-given disadvantages, in particular that is of compact design and that makes it possible to switch in a quick and functionally reliable manner between feeding out and tightening the strap.

SUMMARY OF THE INVENTION

An apparatus for strapping an object has according to the invention a frame, a single drive motor carried on the frame and having an output shaft, a feed roller connected to the motor and rotatable on the frame about a feed axis, and a tightening roller connected to the motor and rotatable on the frame about a tightening axis parallel to the feed axis. A strap from a supply is spanned over and passes between the feed and tightening roller to the object. A lever is pivoted on the frame about an axis parallel to the feed and tightening axes for movement between two angularly offset end positions. A feed counter roller freely rotatable on the lever is engageable in one of the end positions with the feed roller to pinch and advance the strap toward the object, and a tightening counter roller rotatable on the lever is engageable in the other of the end positions with the tightening roller to pinch and pull the strap away from the object. The tightening counter roller is spaced from the tightening roller in the one position and the feed counter roller is spaced from the feed roller in the one end position. A joining device connects the ends of the strap that is wrapped around the object.

In other words, the strapping apparatus of this invention has a lever that presses at least one counter-roller against the feed roller for feeding out the strap or against the tightening roller for tightening the strap.

The counter-roller thus cooperates with the feed roller in order to move the strap out. Alternatively, the counter-roller in question can also provide for an opposite tightening of the strap by the tightening roller. In this case, the procedure is generally such that the strap is either advanced or tightened. In principle, however, the feeding out and tightening of the strap can overlap in time at least in part. In most cases, however, the strap is advanced first. A switch is made to strap tightening, as it were, only after strap feed has been completed.

The invention thus first makes use of a pivotal lever. The pivotal lever is usually rotatably mounted on or against a front side of a plate. On the other hand, the at least one drive motor is located on the rear side of the plate. It is also possible in principle for two drive motors, namely one drive motor for the feed roller and another drive motor for the tightening roller, to be employed here. A single drive motor is used that drives both the feed roller and the tightening roller.

In order to be able to differentiate easily and reliably between a feeding out and tightening of the strap, the lever ensures that the counter-roller is applied against the feed roller in order to drive the strap on the one hand or against the tightening roller in order to tension the strap on the other hand. It is possible in principle to use a single counter-roller.

Generally, however, at least two counter-rollers are provided that are carried by the lever. Each of the counter-rollers is rotatable on the lever for this purpose. That is, the lever supports the at least two counter-rollers, which are a feed counter-roller and a tightening counter-roller.

When pressed against the feed roller, the feed counter-roller ensures that the strap that is pinched between the feed roller and the feed counter-roller is advanced. In contrast, the tightening counter-roller ensures together with the tightening roller that the strap pinched therebetween is or can be oppositely tightened. Each of the two counter-rollers, that is, the feed counter-roller and the tightening counter-roller, is supported in a non-driven manner on the lever so as to be freely rotatable. Consequently, either the feed roller or the tightening roller alone provides for the associated strip displacement.

The change between the feeding out and the tightening of the strap is readily made either by applying the feed counter-roller against the feed roller or, alternatively, the tightening counter-roller against the tightening roller. Since the counter-roller that is no longer needed is lifted off when changing from feeding out to tightening of the strap, both the feed roller and the tightening roller can advantageously continue to be operated and caused to rotate by the single drive motor. That is, the strap is pinched when feeding out the strap and transported between the feed roller and the feed counter-roller. Since the tightening counter-roller is lifted and removed from the tightening roller in this case, the strap can slide without any difficulty over the still-rotating tightening roller.

Conversely, the tightening of the strap corresponds to the fact that the tightening counter-roller is pressed against the tightening roller with the aid of the lever and the strap can be pinched and tightened. Since this action lifts the feed counter-roller and removes it from the feed roller in this case, the feed roller can continue to rotate and the strapping can be guided more or less without resistance over the rotating feed roller.

The change from feeding out the strap to tightening the strap and back is made in an especially simple and functionally reliable manner, because only a slight pivoting of the lever is required for this purpose. In fact, the lever is generally L-shaped. Moreover, the lever usually is pivotally mounted at the outer end of its long L-leg that is usually observed in relation to the above-described plate. In order to switch from feeding out to tightening the strap and back, pivotal movements of the L-shaped lever that correspond to a pivot angle of less than 20° and preferably even of less than 10° and below are generally sufficient. Such pivot angles can be implemented in a quick and mechanically simple manner.

Specifically, the design is such that the lever is rotatably supported not only at the end of its long L-leg, but rather one of the two counter-rollers is also supported on the long L-leg, and the other counter-roller is supported on the short L-leg. One arrangement has proven to be especially favorable in this regard in which the feed counter-roller is connected to the long L-leg of the L-shaped lever approximately in the center. In contrast, the tightening counter-roller is usually located at the outer end of the short L-leg.

The lever is generally moved against the force of at least one spring. The spring ensures that, when the lever is in its neutral position, for example, it occupies a position in which the counter-rollers are spaced from both the feed roller and the tightening roller. In order to now move the lever against the force of the spring and to position the counter-roller against the associated driven roller, an eccentric is generally provided for pivoting the lever. The eccentric is advantageously embodied as or has a cam. The cam can act on a cam roller via a cam roller lever, for example. The cam roller lever, in turn, ensures that the L-shaped lever is pivoted against the force of its spring.

As already explained, it is advantageous to work with a single drive motor that rotates both the feed roller and the tightening roller. To this end, the drive motor generally is connected to the tightening roller via a transmission. The transmission is advantageously a reduction gear, because high torque is generally required for tightening the strap after it has been wrapped around the object to be strapped, and the drive motor is generally built as a fast-running electric motor.

In contrast, no speed reduction of the drive motor is generally required for feeding with the feed roller. In this case, the drive motor is connected to the feed roller through a shaft bearing. The coupling of the drive motor through the transmission on the one hand and with the shaft bearing on the other hand is generally performed via a force-transmission element. The transmission element can be a belt, particularly a toothed belt. In this case, belt pulleys, more particularly toothed belt pulleys on the output shaft of the drive motor on the one hand and on an input shaft of the transmission and on an input shaft of the shaft bearing on the other hand provide for the appropriate force transmission.

In this way, the shaft bearing, the transmission, and the drive motor can be mounted in predominantly coincident alignment on the back of the plate such that their rotation axes are practically parallel to one another. An especially compact design is thus provided, and the weight distribution can be optimized relative to the plate.

As a result, a strapping apparatus is provided that is compact in construction and functionally reliable. This is especially true in the event that existing plastic strapping is to be processed. As will readily be understood, the described strapping apparatus can also be used in conjunction with steel straps, for example. Straps that are made neither of steel nor of plastic are of course also conceivable in principle, such as those which are based on natural raw objects such as natural polymers. Mixed forms can also be used as strap material. By virtue of its compact and condensed design, the described strapping apparatus can in principle be used both for so-called manual tools and for stationary strapping machines. Herein lie the fundamental advantages.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
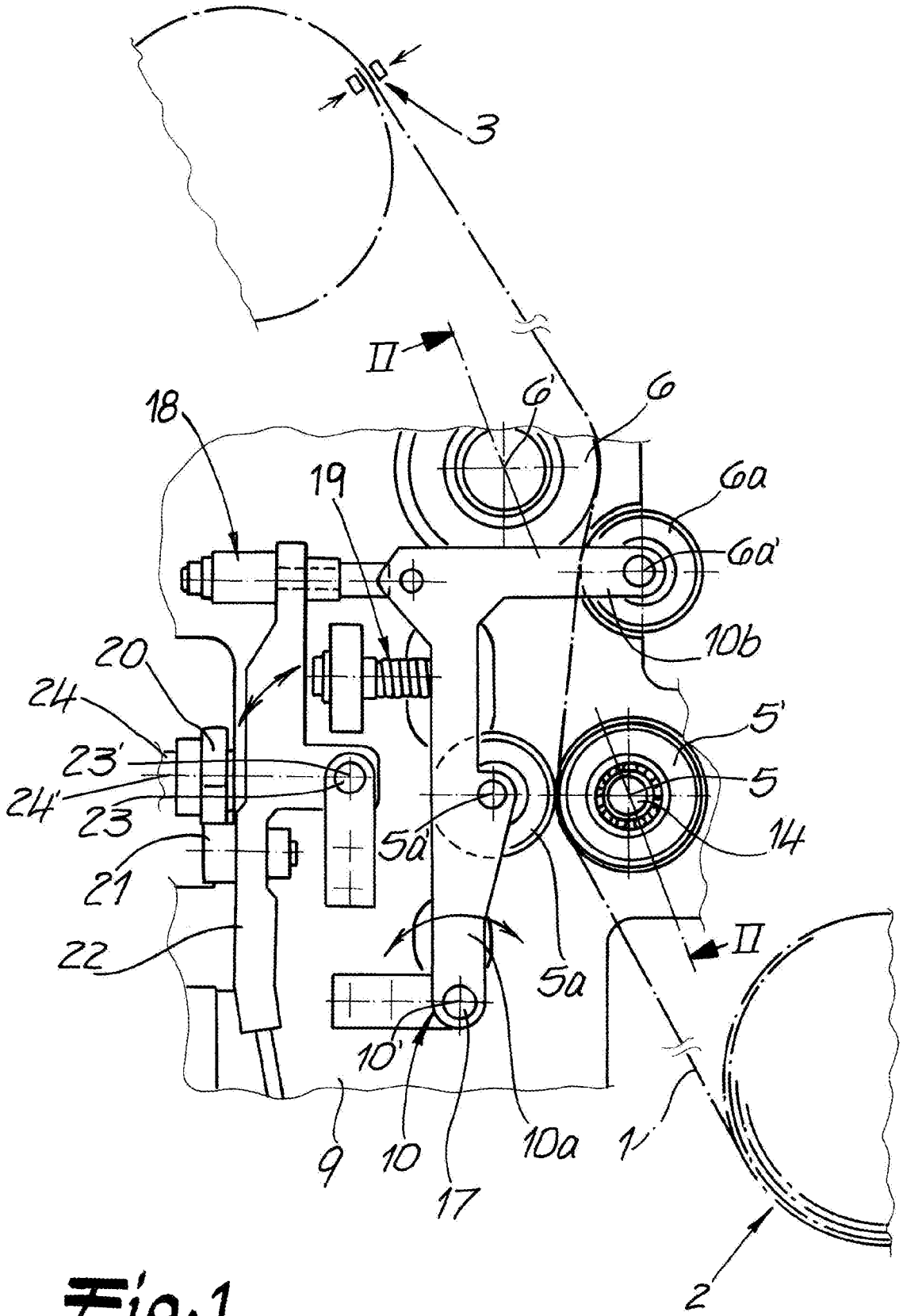
FIG. 1 is a schematic front view of the strapping apparatus according to the invention.

The drawing illustrates a strapping apparatus that can wrap strap 1 around an object or goods to be strapped in a manner that is inherently known and explained in detail in the prior art referred to above. The strap 1 is fed in for this purpose from a strap supply coil 2 shown only in FIG. 1. The strapping apparatus, only portions of which are shown in FIG. 1, also comprises a joining device 3 that is only shown schematically here and in this embodiment and without limitation thereto is embodied as a friction welder. The joining device 3 ensures that ends of the strap 1 to be joined together after having been tightened around the object to be strapped are fixed to each other, in this case by friction welding. As will readily be understood, the joining device 3 can also effect the desired joining of the ends of the strap 1 in other ways. After joining, the strap is cut between the joint and the supply 2 by means not shown, normally a power shear.

Figure 2:
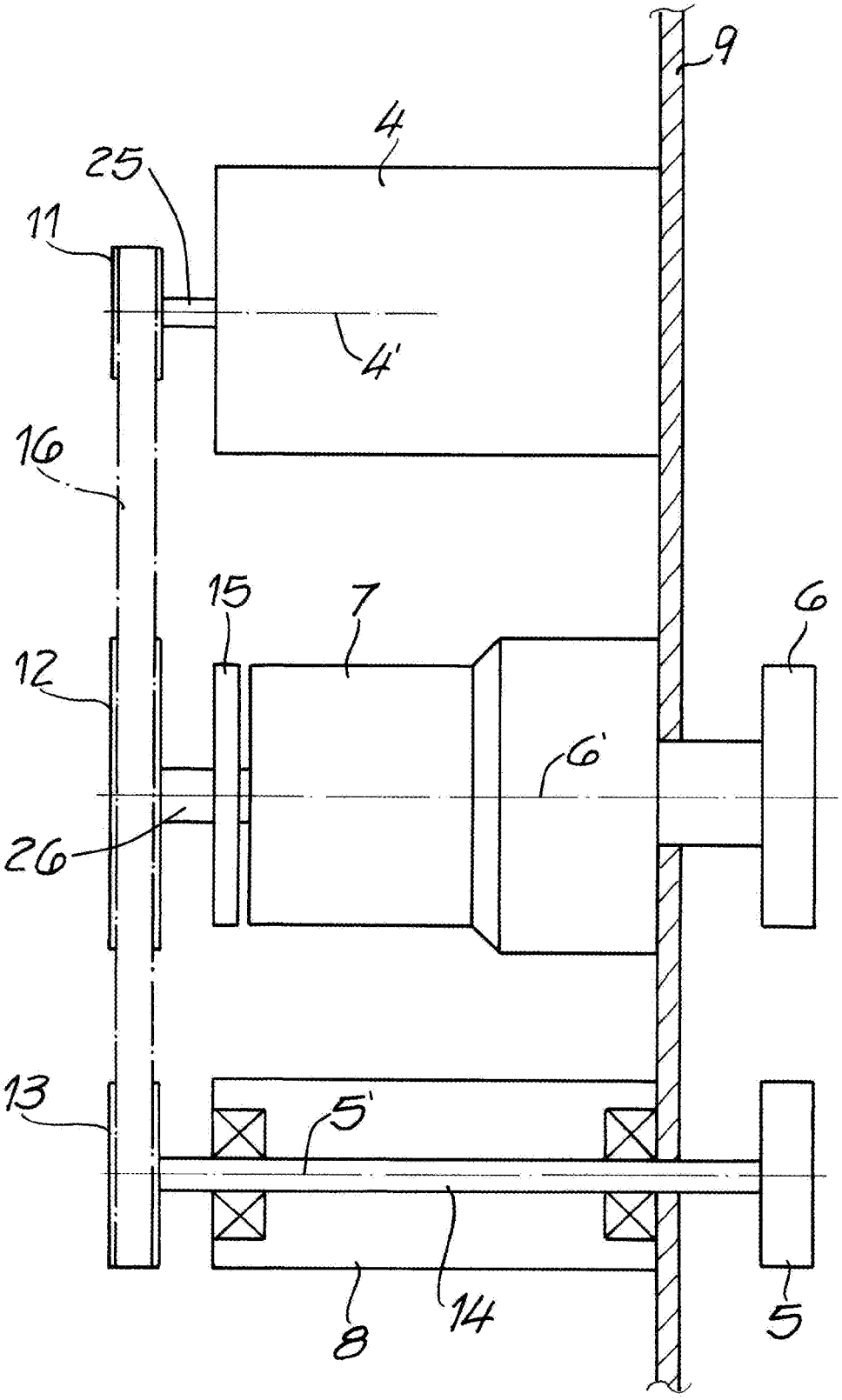
FIG. 2 is a schematic section through the object according to line II-II of FIG. 1.

FIG. 2 further shows elements essential for the present invention, namely a drive motor 4 that in this embodiment and without limitation thereto rotates both a feed roller 5 and a tightening roller 6 about respective parallel axes 5' and 6'. As can be seen in FIG. 2, the drive motor 4 is a (single) electric motor that, like a step-down transmission 7 and a shaft bearing 8 that are also visible here, are all mounted on the rear side of a mounting or frame plate 9. A lever 10, which will be considered in greater detail below, is mounted on the front side of the plate 9.

As can be seen in section in FIG. 2, the drive motor 4, the transmission 7, and the shaft bearing 8 are each mounted on the plate 9 so their axes 4', 6', and 5' are parallel to one another and perpendicular to the plate 9. Optimal weight distribution can thus be achieved. Moreover, mounting of the drive motor 4 "next to" the transmission 7 and the shaft bearing 8 ensures that the above-described elements 4, 7, 8 require relatively little installation space perpendicularly away from the plate 9. The motor 4 has an output shaft 25 carrying a belt pulley 11 for rotation about the axis 4'. A comparable belt pulley 12 is located on an input shaft 26 of the transmission 7. Likewise, an additional pulley 13 is mounted on the input end of a shaft 14 that is supported within the shaft bearing 8, defines the axis 5', and carries the feed roller 5 at its output end on the other side of the frame plate 9. In addition, the transmission 7 is equipped with an integrated brake 15 that merely represents an option and ensures or can ensure that the transmission 7 and with it the tightening roller 6 mounted on its output shaft are stopped on completion of tightening of the strap 1.

The individual belt pulleys 11, 12, 13 are driven synchronously by the drive motor 4 in this embodiment via a common transmission element 16, here a flexible toothed belt. Accordingly, in this embodiment and without limitation thereto the individual pulleys 11, 12, 13, which rotate about parallel axes 4' 6', and 5', are also toothed. Overall, the drive motor 4 ensures that the transmission 7 also continuously rotates tightening roller 6 as well as the feed roller 5 via the interposed shaft bearing 8.

In order to switch between a feeding out of the strap 1 already described above and a tightening of the strap, the above-mentioned pivotal two-arm lever 10 is provided according to the invention. The lever 10 is pivoted to the front side of the plate 9 on a pivot 17 defining a lever axis 10' parallel to the axes 4,', 5', and 6'. This lever 10 carries at least two counter-rollers 5*a* and 6*a* freely rotatable about respective axes 5*a*' and 6*a*' parallel to the other axes 4', 5, and 6', the counter-roller 6*a* is juxtaposed with the tightening roller 6 and is thus embodied as a tightening counter-roller 6*a*. In contrast, the other counter-roller 5*a* is a feed counter-roller 5*a* juxtaposed with the feed roller 5, as will be explained in more detail below.

It can be seen from the front view of FIG. 1 that the lever 10 is L-shaped with a long L-leg 10*a* and a short L-leg 10*b*. According to this embodiment, the feed counter-roller 5*a* is rotatably mounted in the center lengthwise of the long L-leg 10*a*. In contrast, the tightening counter-roller 6*a* is rotatably mounted on the outer end of the short L-leg 10*b*.

The lever 10 can be pivoted slightly back and forth between end positions described below as indicated by a double arrow in FIG. 1 about its pivot axis 10' defined by a pivot 17 that is here on the front side of the plate 9. The angular stroke of the L-shaped lever 10 between its end positions is generally less than 20° and usually even only 10° or less. The lever 10 is moved as a whole against the force of oppositely effective springs 18 and 19. In fact, in the context of this embodiment, a spring 18 that is associated with strap tightening and another spring 19 that primarily is effective when feeding out the strap 1 are provided.

In order to pivot the L-shaped lever 10, an eccentric abutment mechanism 20, 21, 22 is provided. The eccentric mechanism 20, 21, 22 is composed specifically of a cam 20 carried on a shaft 24 and a cam roller 21 carried on a cam roller lever 22. The cam roller lever 22 is carried on a pivot 23 defining an axis 23' also parallel to the axes 4, 5, 6, and 10'.

Rotation of the cam 20 about its axis 24' extending on the drawing plane or parallel thereto and perpendicular to all the other axes 4', 5', 6', and 10' has the effect that the cam roller lever 22 pivots on its pivot 23 via the cam roller 21, as is likewise indicated in FIG. 1. The L-shaped lever 10 is pivoted as a consequence of this, because the cam roller lever 22 bears at the end of the short L-leg 10*b* of the L-shaped lever 10 that is opposite the tightening counter-roller 6*a* on the cam 20, thereby "entraining" the lever 10 in its pivoting movement.

For example, to feed out the strap 1, the L-shaped lever 10 is pivoted in the clockwise direction about its pivot 17 into its end feeding-out end position by rotation of the cam 20 to rotate the lever 22 clockwise and thereby rotate the lever 10 also clockwise and press the counter feed roller 5*a* against the feed roller 5. As a result, the feed counter-roller 5*a* comes to rest against the feed roller 5, and the strap 1 is pinched between the two rollers 5 and 5*a*. Consequently, the strap 1 is unwound at a relatively high speed from the strap supply 2 and can be wrapped around the object to be strapped by a strap guide for example. As soon as the strap 1 has been wrapped around the object, the loop of strap 1 around the object being strapped is cut from the strap supply 2 by the unillustrated cutter.

The strap 1 is then tightened. To this end, the cam 20 allows the lever to pivot counterclockwise from the FIG. 1 position, such that the counter roller 5*a* pulls away from the roller 5, the counter roller 6*a* moves toward the roller 6, and the strap 1 is pinched between the tightening roller 6 and the tightening counter-roller 6*a*. The lever 10 is acted upon in the opposite counterclockwise direction by the eccentric 20, 21, 22 and moves into the opposite tightening end position under the force of the much stronger spring 18. As a result, the feed counter-roller 5*a* moves away from the feed roller 5, and the tightening counter-roller 6*a* pinches the strap against the tightening roller 6 instead, while compressing the weaker spring 19. The strap 1 that is pinched between the two rollers 6 and 6*a* can thus be tightened at slow speed with high torque applied to the rollers 6 and 6*a*. Moreover, the tightened ends of the strap 1 can be joined together by the joining device 3 as described above.

We claim:

1. An apparatus for strapping an object, the apparatus comprising:

a frame plate having a front side and a back side;

a single drive motor carried on the back side of the frame plate and having an output shaft;

a driven feed roller connected to the motor and rotatable on the frame plate about a feed axis;

a tightening roller connected to the motor and rotatable on the frame plate about a tightening axis parallel to the feed axis, a strap from a supply being spanned over and passing between the feed and tightening roller to the object;

a lever pivoted on the front side of the frame plate about an axis parallel to the feed and tightening axes for movement between two angularly offset end positions;

a feed counter roller freely rotatable on the lever and engageable in one of the end positions of the lever with the driven feed roller to pinch and advance the strap toward the object;

a tightening counter roller rotatable on the lever and engageable in the other of the end positions with the tightening roller to pinch and pull the strap away from the object, the tightening counter roller being spaced from the tightening roller when the lever is in the one end position and the feed counter roller being spaced from the driven feed roller when the lever is in the other end position;

a joining device for connecting the ends of the strap that is wrapped around the object;

a transmission on the back side of the plate and connected between the drive motor and the tightening roller;

a bearing on the back side of the plate;

a shaft in the bearing and connected between the driven feed roller and the drive motor;

respective input wheels on the motor output shaft, the transmission, and the bearing, the input wheels being on the back side of the plate; and a flexible drive element interconnecting the input wheels.

2. The apparatus defined in claim 1, wherein the drive motor continuously rotates both the driven feed roller and the tightening roller.

3. The apparatus defined in claim 1, further comprising:

a transmission between the drive motor and the tightening roller so that the driven feed roller rotates at a higher speed than the tightening roller.

4. The apparatus defined in claim 1, further comprising:

a bearing on the plate holding a shaft connected between the driven feed roller and the drive motor.

5. The apparatus defined in claim 1, wherein the wheels are toothed pulleys and the drive element is a toothed belt.

6. The apparatus defined in claim 1, wherein the lever has a long leg and a short leg extending transversely from an end of the long leg.

7. An apparatus for strapping an object, the apparatus comprising:

a frame;

a single drive motor carried on the frame and having an output shaft;

a feed roller connected to the motor and rotatable on the frame about a feed axis;

a tightening roller connected to the motor and rotatable on the frame about a tightening axis parallel to the feed axis, a strap from a supply being spanned over and passing between the feed and tightening roller to the object;

a lever having a long leg with an outer end pivoted on the frame about an axis parallel to the feed and tightening axes for movement of the lever between two angularly offset end positions and another end from which a short leg extends transversely;

a feed counter roller freely rotatable on the lever and engageable in one of the end positions with the driven feed roller to pinch and advance the strap toward the object, the feed counter roller being carried on the long leg between the ends thereof;

a tightening counter roller rotatable on the lever and engageable in the other of the end positions with the tightening roller to pinch and pull the strap away from the object, the tightening counter roller being spaced from the tightening roller when the lever is in the one end position and the feed counter roller being spaced from the driven feed roller when the lever is in the other end position, the counter roller being carried on an outer end of the short leg; and a joining device for connecting the ends of the strap that is wrapped around the object.

8. An apparatus for strapping an object, the apparatus comprising:

a frame;

a single drive motor carried on the frame and having an output shaft;

a feed roller connected to the motor and rotatable on the frame about a feed axis;

a tightening roller connected to the motor and rotatable on the frame about a tightening axis parallel to the feed axis, a strap from a supply being spanned over and passing between the feed and tightening roller to the object;

a lever pivoted on the frame about an axis parallel to the feed and tightening axes for movement between two angularly offset end positions;

a feed counter roller freely rotatable on the lever and engageable in one of the end positions with the driven feed roller to pinch and advance the strap toward the object;

a tightening counter roller rotatable on the lever and engageable in the other of the end positions with the tightening roller to pinch and pull the strap away from the object, the tightening counter roller being spaced from the tightening roller when the lever is in the one end position and the feed counter roller being spaced from the driven feed roller when the lever is in the other end position;

a joining device for connecting the ends of the strap that is wrapped around the object; and a spring urging the lever into the one end position.

9. The apparatus defined in claim 8, further comprising:

another spring urging the lever into the other end position.

10. The apparatus defined in claim 9, further comprising:

a cam actuator operable for preventing the other spring from moving the lever into the other end position but disengageable to allow the other spring to overcome the one spring and press the counter roller against the counter roller.

* * * * *